US006553704B1

(12) United States Patent
Pigg

(10) Patent No.: US 6,553,704 B1
(45) Date of Patent: Apr. 29, 2003

(54) PICTURE FRAME WITH SLIDE OUT PICTURE HOLDERS

(76) Inventor: Arthur Pigg, 3636 Rocky Shore Dr., Vallejo, CA (US) 94591

( * ) Notice: Subject to any disclaimer, the term of this patent is extended or adjusted under 35 U.S.C. 154(b) by 2 days.

(21) Appl. No.: 10/039,690

(22) Filed: Jan. 3, 2002

(51) Int. Cl.[7] ..... A47G 1/06

(52) U.S. Cl. ..... 40/734; 40/765; 40/745; 40/721

(58) Field of Search ..... 40/661, 649, 611, 40/747, 765, 771, 776, 745, 721, 734

(56) References Cited

U.S. PATENT DOCUMENTS

| | | | | | |
|---|---|---|---|---|---|
| 1,068,621 | A | | 7/1913 | Abraham | |
| 1,436,544 | A | * | 11/1922 | Starr | 40/747 |
| 1,626,150 | A | * | 4/1927 | Parda | 40/721 |
| 2,649,799 | A | | 8/1953 | Spertus | |
| 2,737,745 | A | * | 3/1956 | Hartmann | 40/721 |
| 2,796,689 | A | | 6/1957 | Yannone | |
| 2,839,857 | A | | 6/1958 | Teller | |
| 2,844,897 | A | * | 7/1958 | Vance | 40/611 |
| 3,771,244 | A | * | 11/1973 | Ebner | 40/721 |
| 4,630,386 | A | | 12/1986 | Wilson | |
| 5,077,921 | A | * | 1/1992 | Mooney | 40/771 |
| 5,400,532 | A | | 3/1995 | Grove | |

* cited by examiner

*Primary Examiner*—Gary Hoge
(74) *Attorney, Agent, or Firm*—Jack Lo

(57) ABSTRACT

A picture frame is comprised of a frame with open opposite sides for displaying pictures on both sides. Partitions in the frame define slots that receive picture holders. Entrances to the slots are arranged on one edge of the frame. Each picture holder is comprised of two transparent sheets joined along three edges. An open edge is arranged for receiving a picture. Offset notches along the partitions between the slots enable the holders to be grabbed more easily. A pin is inserted through tabs projecting from the partitions for locking in the holders. The frame is pivoted on a base, so that the frame can be pivoted back when reversed. A slidable arm is attached to the base, and is slid toward the side that the frame is tilted to improve stability.

7 Claims, 4 Drawing Sheets

PICTURE FRAME WITH SLIDE OUT PICTURE HOLDERS

BACKGROUND OF THE INVENTION

1. Field of the Invention

This invention relates generally to picture frames.

2. Prior Art

Most picture frames are limited to holding a single picture. Changing the picture requires removing the back of the frame. Other picture frames are arranged for storing a stack of pictures for easier interchangeability. U.S. Pat. No. 1,068,621 to Abraham discloses a frame with a bracket on the back which is thick enough to hold a stack of pictures, so that the desired picture may be rotated to the front. Each picture is provide with a tab for being pulled out. However, the tabs protrude so much that a wide frame is necessary for hiding them.

U.S. Pat. No. 2,649,799 to Spertus discloses a frame with a loose leaf album inside. The picture to be displayed must be removed from the album and placed behind the display window. U.S. Pat. No. 2,796,689 to Yannone discloses a frame that displays two pictures back-to-back. It is limited to holding only two pictures, and it cannot angle the pictures back for better viewing. U.S. Pat. No. 2,839,857 to Teller discloses a frame with slots for receiving a plurality of pictures. Each picture has a tab for being pulled out. Since the tabs are visible on the back, the frame is only suitable for wall mounting. U.S. Pat. No. 4,630,386 to Wilson discloses that displays two pictures back-to-back. It is limited to holding only two pictures. U.S. Pat. No. 5,400,532 to Grove discloses a frame that can hold a stack of pictures. The desired picture may be rotated to the front for display. A leg on the back supports the frame at a fixed angle.

BRIEF SUMMARY OF THE INVENTION

The objects of the present picture frame are:

to store a plurality of pictures;

to display pictures on both sides;

to allow the frame to be tilted back when reversed;

to stabilize the frame when the frame is tiled to an opposite position;

to enable the desired pictures to be easily positioned behind the display windows;

to protect the pictures with holders;

to allow the pictures to be easily removed from the holders;

to enable the pictures to be easily removed from the frame without using tabs; and to lock the pictures in for security.

The present picture frame is comprised of a frame with open opposite sides for displaying pictures on both sides. Partitions in the frame define slots that receive picture holders. Entrances to the slots are arranged on one edge of the frame. Each picture holder is comprised of two transparent sheets joined along three edges. An open edge is arranged for receiving a picture. Offset notches along the partitions between the slots enable the holders to be grabbed more easily. A pin is inserted through tabs projecting from the partitions for locking in the holders. The frame is pivoted on a base, so that the frame can be pivoted back when reversed. A slidable arm is attached to the base, and is slid toward the side that the frame is tilted to improve stability.

Figure 1:
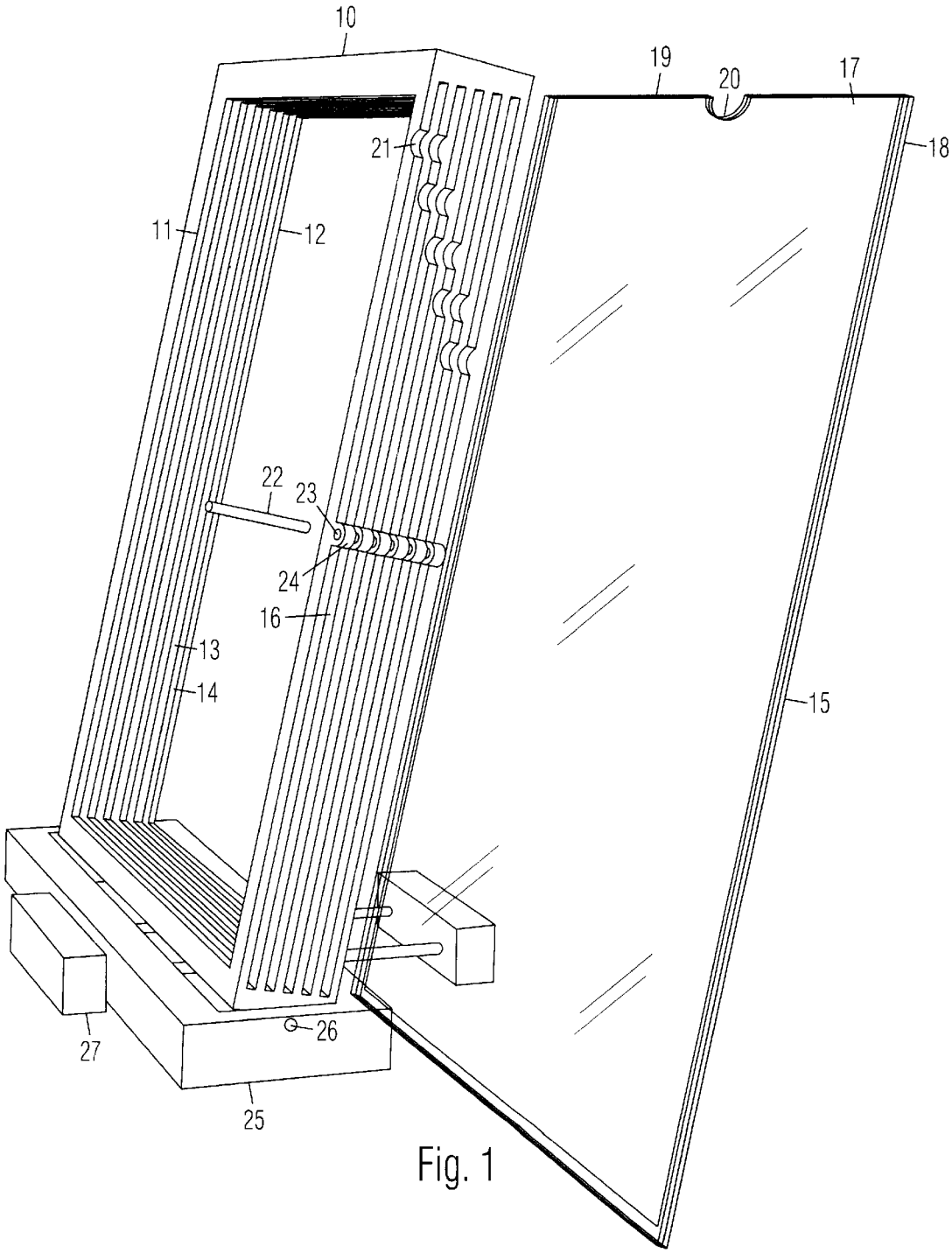
FIG. 1 is a side perspective exploded view of the present picture frame.

| DRAWING REFERENCE NUMERALS | |
|---|---|
| 10. Frame | 11. Open Side |
| 12. Open Side | 13. Partitions |
| 14. Slots | 15. Picture Holder |
| 16. Entrances | 17. Transparent Sheet |
| 18. Transparent Sheet | 19. Open Edge |
| 20. Notch | 21. Notches |
| 22. Pin | 23. Holes |
| 24. Tabs | 25. Base |
| 26. Pivots | 27. Arm |
| 29. Picture | 30. Picture |

DETAILED DESCRIPTION OF THE INVENTION

FIG. 1

A preferred embodiment of the present picture frame is shown in a side perspective view in FIG. 1. It is comprised of a frame 10 with open opposite sides 11 and 12 for displaying pictures on both sides. Partitions 13 in frame 10 define slots 14 for receiving picture holders 15. Entrances 16 to slots 14 are arranged on one edge of frame 10. Each picture holder 15 is comprised of two transparent sheets 17 and 18 joined along three edges. An open edge 19 is arranged for receiving one picture or two pictures positioned back-to-back (not shown). A notch 20 is provided along the open edge to facilitate removal of the picture.

Pairs of notches 21 are provided along partitions 13 on opposite sides of respective slots 14 to facilitate removal of holders 15. The notches in each pair are aligned with each other, but the pairs are offset from one another to allow picture holders 15 to be more easily grabbed. A pin 22 is for being inserted through holes 23 in aligned tabs 24 projecting from partitions 13 on the side of entrances 16 for locking in picture holders 15. Frame 10 is pivotally attached to a base 25 by pivots 26, so that frame 10 can be pivoted back from the side being displayed. A horizontally slidable arm 27 is attached to base 25 and arranged to slide forward and backward. Arm 27 may be slid toward the side that frame 10 is tilted to improve stability.

FIG. 2

Figure 2:
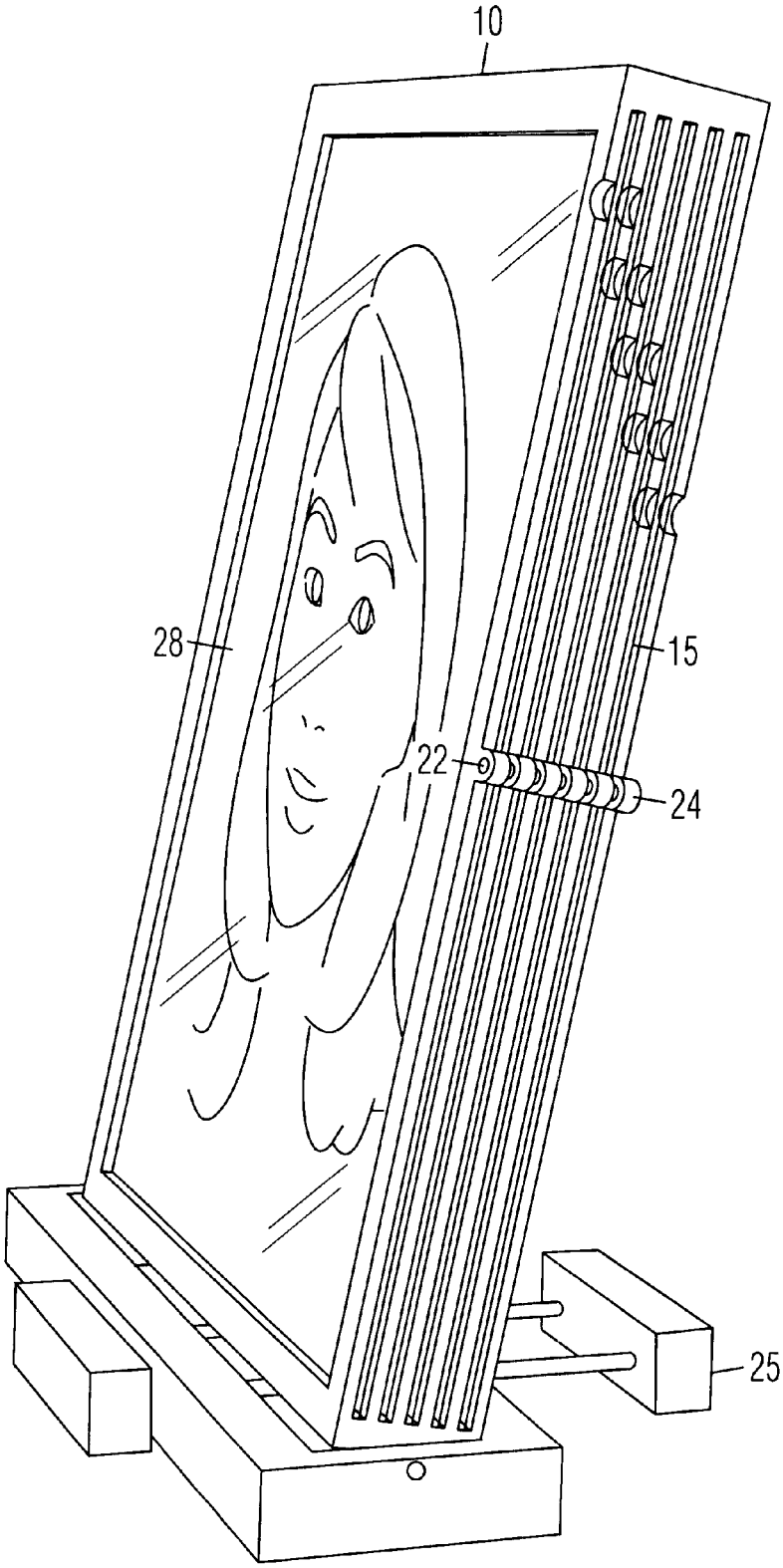
FIG. 2 is a side perspective view thereof with pictures inserted.

The picture frame is shown in FIG. 2 with holders 15 inserted in slots 14. Pin 22 is inserted through tabs 24 to lock in holders 15. Frame 10 is tilted back to display a picture 28 in the front holder. Arm 25 is slid toward the side that frame 10 is tilted to improve stability.

FIG. 3

Figure 3:
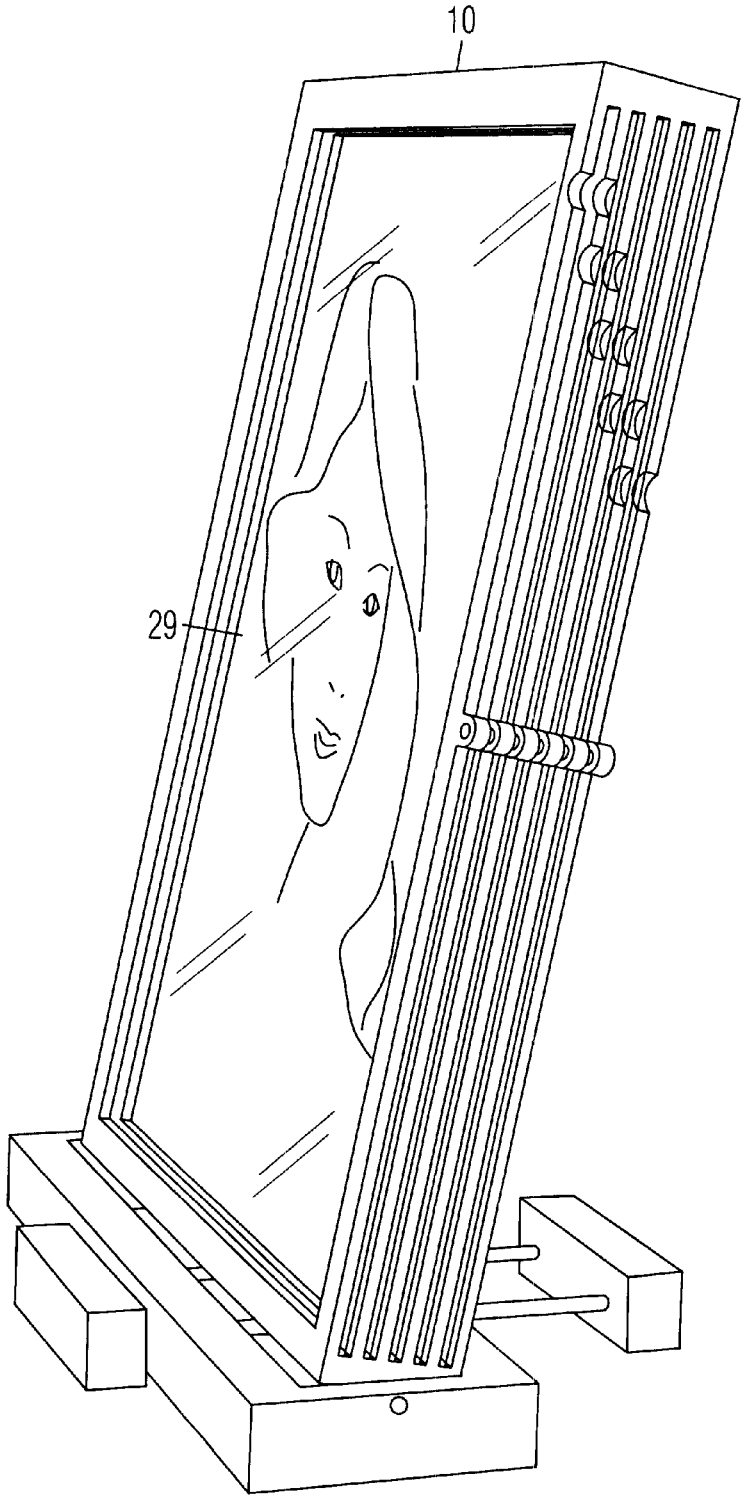
FIG. 3 is a side perspective view thereof with the first picture removed.

The picture frame is shown in FIG. 3 with the first picture holder removed to display a second picture 29 in a second picture holder. Additional picture holders can be quickly removed to display any of the remaining pictures. The removed pictures are protected by the picture holders. Alternatively, the desired picture can be rotated to the front, and the unwanted picture may be stored in the slot vacated by the desired picture.

FIG. 4

Figure 4:
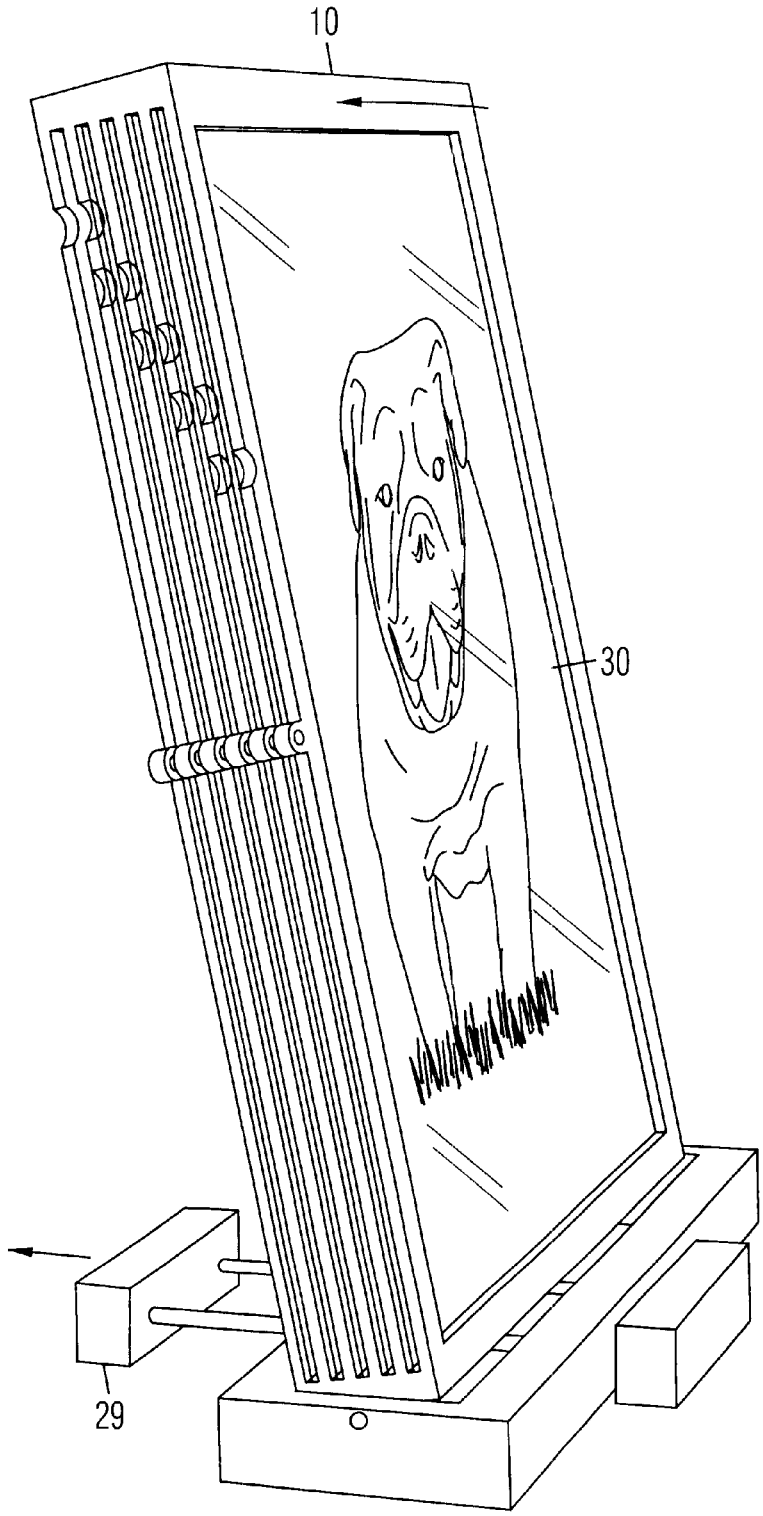
FIG. 4 is a side perspective view thereof reversed to display another picture.

The picture frame is shown in FIG. 4 reversed to display on a picture 30 on the reverse side. Frame 10 is tilted back from the side of the displayed picture for better viewing.

Arm 27 is slid toward the side that frame 10 is tilted to improve stability.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A picture frame, comprising:

a frame with open opposite sides for displaying pictures on both sides;

partitions in said frame defining slots parallel to said sides;

entrances to respective slots arranged on an edge of said frame; and picture holders detachably received in respective slots, each of said picture holders comprising two transparent sheets joined along three edges, an open edge arranged for receiving up to two pictures positioned back-to-back for displaying said pictures on both sides of said frame, wherein an outermost of said picture holders on each of said sides of said frame is removable to display a subsequent picture holder.

2. The picture frame of claim 1, further including pairs of notches on said partitions adjacent said entrances to facilitate removal of said picture holders, wherein said notches in each of said pairs are on adjacent partitions and aligned with each other, said pairs of notches are offset from one another for facilitating grabbing said picture holders.

3. The picture frame of claim 1, further including tabs projecting from respective partitions adjacent said entrances and aligned with each other, and a pin detachably inserted through said tabs and locking in said picture holders.

4. A picture frame, comprising:

a frame with open opposite sides for displaying pictures on both sides;

partitions in said frame defining slots parallel to said sides;

entrances to respective slots arranged on an edge of said frame;

picture holders detachably received in respective slots, each of said picture holders comprising two transparent sheets joined along three edges, an open edge arranged for receiving up to two pictures positioned back-to-back for displaying said pictures on both sides of said frame, wherein an outermost of said picture holders on each of said sides of said frame is removable to display a subsequent picture holder;

a base pivoted to a lower end of said frame, wherein said frame is tiltable back from the side of said frame with a picture being viewed; and a horizontal arm attached to said base and movable toward either side of said frame, wherein said arm is movable toward the side that said frame is tilted to improve stability.

5. The picture frame of claim 4, further including pairs of notches on said partitions adjacent said entrances to facilitate removal of said picture holders, wherein said notches in each of said pairs are on adjacent partitions and aligned with each other, said pairs of notches are offset from one another for facilitating grabbing said picture holders.

6. The picture frame of claim 4, further including tabs projecting from respective partitions adjacent said entrances and aligned with each other, and a pin detachably inserted through said tabs and locking in said picture holders.

7. A picture frame, comprising:

a frame with open opposite sides for displaying pictures on both sides;

partitions in said frame defining slots parallel to said sides;

entrances to respective slots arranged on an edge of said frame;

picture holders detachably received in respective slots, each of said picture holders comprising two transparent sheets joined along three edges, an open edge arranged for receiving up to two pictures positioned back-to-back for displaying said pictures on both sides of said frame, and a notch along said open edge for facilitating removal of said pictures, wherein an outermost of said picture holders on each of said sides of said frame is removable to display a subsequent picture holder;

pairs of notches on said partitions adjacent said entrances to facilitate removal of said picture holders, wherein said notches in each of said pairs are on adjacent partitions and aligned with each other, said pairs of notches are offset from one another for facilitating grabbing said picture holders;

tabs projecting from respective partitions adjacent said entrances and aligned with each other;

a pin detachably inserted through said tabs and locking in said picture holders;

a base pivoted to a lower end of said frame, wherein said frame is tiltable back from the side of said frame with a picture being viewed; and a horizontal arm attached to said base and movable toward either side of said frame, wherein said arm is movable toward the side that said frame is tilted to improve stability.

* * * * *